US005611100A

United States Patent [19]

Zigelboim et al.

[11] Patent Number: 5,611,100

[45] Date of Patent: Mar. 18, 1997

[54] PAINT ROLLER

[76] Inventors: Ilan Zigelboim; Virginia B. Hagan, both of 4955 NW. 82nd Ter., Lauderhill, Fla. 33351

[21] Appl. No.: 622,107

[22] Filed: Mar. 26, 1996

Related U.S. Application Data

[63] Continuation-in-part of Ser. No. 415,451, Apr. 3, 1995, Pat. No. 5,509,165, and a continuation-in-part of Ser. No. 037,008, Apr. 3, 1995, Pat. No. Des. 369,027, and a continuation-in-part of Ser. No. 049,835, Feb. 1, 1996, Pat. No. Des. 376,911.

[51] Int. Cl.[6] ..... B05C 17/02

[52] U.S. Cl. ..... 15/230.11; 492/13; 492/19; D4/122

[58] Field of Search ..... 15/230.11; 492/13, 492/14, 19; D4/122, 123

[56] References Cited

U.S. PATENT DOCUMENTS

| | | | |
|---|---|---|---|
| D. 239,860 | 1/1988 | Smith | D4/122 |
| D. 320,888 | 10/1991 | Parizek | D4/122 |
| 525,217 | 8/1894 | Jones | 492/13 |
| 1,534,559 | 4/1925 | Yant | 492/13 |
| 2,702,917 | 3/1955 | Lynden | 15/230.11 |
| 2,811,733 | 11/1957 | Sloan | 15/230.11 |
| 3,593,361 | 7/1971 | Welt | 15/230.11 |
| 3,599,268 | 8/1971 | Simpkins et al. | 15/230.11 |
| 3,604,046 | 9/1971 | Taylor | 15/230.11 |
| 3,714,674 | 2/1973 | Simoncioni | 15/230.11 |
| 3,745,624 | 7/1973 | Newman . | |
| 3,967,339 | 7/1976 | Newman | 15/230.11 X |
| 4,335,484 | 6/1982 | Ridge et al. | 15/230.11 |
| 4,571,769 | 2/1986 | Ford | 15/230.11 |
| 5,509,165 | 4/1996 | Zigelboim et al. | 15/230.11 |

FOREIGN PATENT DOCUMENTS

| | | | |
|---|---|---|---|
| 180520 | 12/1959 | Austria | 15/230.11 |
| 75804 | 5/1953 | Denmark | 15/230.11 |
| 823204 | 11/1959 | United Kingdom . | |
| 828727 | 2/1960 | United Kingdom . | |

*Primary Examiner*—Mark Spisich
*Attorney, Agent, or Firm*—Richard C. Litman

[57] ABSTRACT

A lightweight paint roller frame for supporting a long cylinder. The present frame will accommodate a cylinder of a such a length that painting can be accomplished more quickly. This cylinder, because of its length, approximately two to three feet, has a unique support structure. The cylinder has uniformly spaced wheels along its length and is supported on both of its ends by a lightweight frame. To facilitate removal of a cover or nap from the cylinder, a rod which extends through the frame and the cylinder is removed. The frame is lightweight because it is made of plastic. The frame is preferably triangular and the area within the frame is substantially open. Support elements running within the open area of the frame are used to provide additional support to the frame without adding the weight of a solid area.

13 Claims, 3 Drawing Sheets

PAINT ROLLER

This application is a continuation-in-part of Ser. No. 08/415,451 filed Apr. 3, 1995 U.S. Pat No. 5,509,165; a continuation-in-part of Ser. No. 29/037,008 filed Apr. 3, 1995 U.S. Pat. No. Des. 369,027; and a continuation-in-part of Ser. No. 29/049,835 filed Feb. 1, 1996, U.S. Pat. No. Des. 276,911.

BACKGROUND OF THE INVENTION

1. Field of the Invention

The present invention relates to a paint roller, specifically one having a cylinder of greater than normal length and including a support structure for the cylinder.

2. Description of the Prior Art

An impediment to producing paint rollers for covering a significant amount of area in a relatively short time is that the length of the cylinder that can be accommodated by the paint roller frame is constrained by critical support limitations. A long cylinder and associated nap or cover can enable a paint roller to paint a large surface area.

The present invention addresses this support limitation by providing a frame which supports the cylinder at both of its ends. Many commercially available paint roller frames, for example the frame as seen in U.S. Pat. No. 3,745,624, issued on Jul. 17, 1973 to Newman, support cylinders at only one end. Thus, these commercially available paint rollers cannot practically support a long cylinder capable of painting a large area quickly. Further these frames providing support on only one side may suffer from the problems of uneven roller wear, which may result in uneven painting.

Rollers in which both ends of the cylinder are supported by a frame have been contemplated. U.S. Pat. Nos. 1,534,559, issued on Apr. 21, 1925 to W. R. Yant, 2,72,917, issued on Mar. 1, 1955 to C. P. Lynden, 2,811,733, issued on Nov. 5, 1957 to M. E. Sloan, 3,593,361, issued on Jul. 20, 1971 to David I. Welt, 3,604,046, issued on Sep. 14, 1971 to Harold J. Taylor, and 3,714,674, issued on Feb. 6, 1973 to O. M. Simoncioni, and British Patent Nos. 823,204, issued on Nov. 11, 1959, and 828,727, issued on Feb. 24, 1960, teach frames for paint rollers or similar applicators that support the roller on both sides.

The nature of a frame which supports a roller on both sides requires that the frame have means for releasing the roller, for example the pivot of Yant or the removable sections of Lynden's frame. The instant means for removal of a roller is a single rod that protrudes through the frame and the cylinder and is easily removed. None of the prior art references disclose such a means for removal, and for this reason alone, the instant invention defines over the art.

However, the instant invention also encompasses a unique frame which provides not only the added support needed for a long roller, but also the light weight required for a fully utilitarian paint roller. Because of this light weight, the paint roller can be used, with an extension pole, to paint ceilings. It is noted that the instant frame is always used with a handle of some length. The handle, which can be attached to the frame by any known means, such as threads, adds additional strength to the frame.

The present frame, which is preferably made of plastic, is light in weight because it is substantially open. By open, it is meant that the area within the frame is not solid. A solid frame, which is seen in U.S. Pat. No. Des. 293,860, issued on Jan. 26, 1988 to Morley L. Smith, is heavier and cannot be used as well on ceilings, where light weight is important.

In furtherance of the seemingly conflicting goals of being lightweight and providing adequate support for a long roller, the frame includes support members, which traverse the open space within the frame. These support elements provide the required support to the frame, yet do not add the additional weight of a solid frame. None of the prior art references teach support members within the frame.

None of the above inventions and patents, taken either singly or in combination, is seen to describe the instant invention as claimed.

SUMMARY OF THE INVENTION

The present frame will accommodate a cylinder of a such a length that painting can be accomplished more quickly. This cylinder, because of its length, approximately two to three feet, has a unique support structure. The cylinder has uniformly spaced wheels along its length and is supported on both of its ends by a lightweight frame. To facilitate removal of a cover or nap from the cylinder, a rod which extends through the frame and the cylinder is removed. The frame is lightweight because it is made of plastic. The frame is preferably triangular and the area within the frame is substantially open. Support elements running within the open area of the frame are used to provide additional support to the frame without adding the weight of a solid area. The central support element includes an opening for receiving a handle. The location of a handle in the central support element increases strength.

Accordingly, it is a principal object of the invention to provide a paint roller with an elongated cylinder for greater coverage relative to the time spent painting.

It is another object of the invention to provide a light weight yet fully supported frame.

It is a further object of the invention to provide means to remove the cylinder from the frame.

It is yet another object to provide a cylinder that has support elements along its length.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
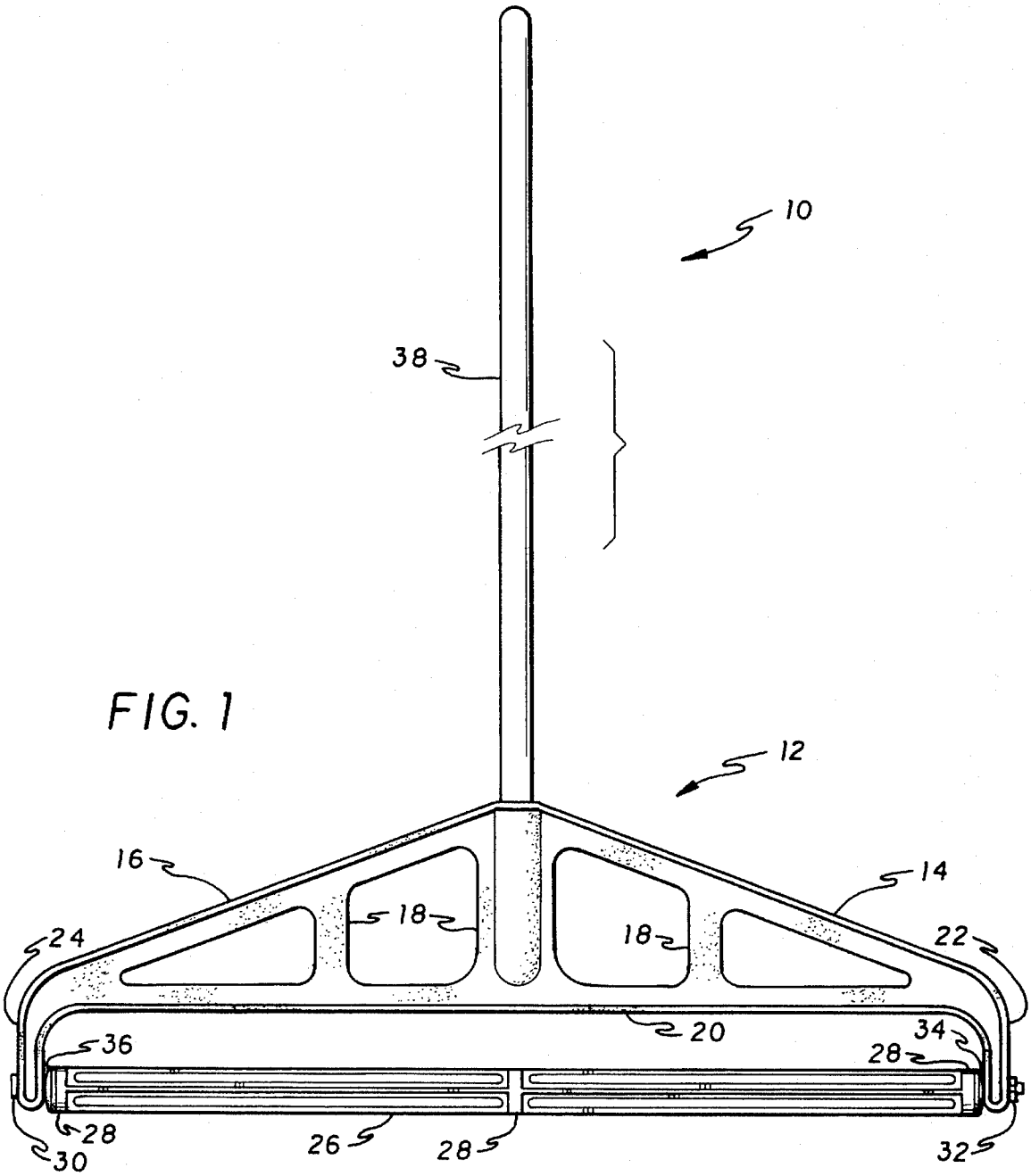
FIG. 1 is a front elevational view of the paint roller.

The present invention relates to a paint roller 10 having a supportive frame 12, preferably plastic, and a cylinder assembly 40. The cylinder assembly is preferably two to three feet long in order that large areas can be quickly painted. Cylinder assemblies of longer length can be used, the length being constrained only by weight limitations. Because of this relatively long length, a great deal of support must be provided.

Support is provided by the frame 12 at both ends of the cylinder assembly 40. The frame 12 may be triangular shaped with a hypotenuse 20 and left and right legs 14 and 16. The hypotenuse 20 runs parallel to the cylinder assembly 40. The left and the right legs 14 and 16 run from points at either end of the hypotenuse 20 to a point of convergence above, i.e. away from the cylinder assembly 40, the midpoint of the hypotenuse 20.

The legs 14 and 16 and the hypotenuse 20 have thicknesses to provide a strong frame. However, the area between the legs 14 and 16 and the hypotenuse 20 is substantially open to reduce the weight of the frame, which is very important because of the long cylinder assembly 40 in painting overhead. Supports 18, preferably three, running perpendicular to the cylinder assembly 40 provide additional support to the frame 12. The central support 18 has an opening in which an extension pole 38 can be attached. The frame 12 also includes left and right arms 22 and 24 which support the cylinder assembly 40.

Figure 4:
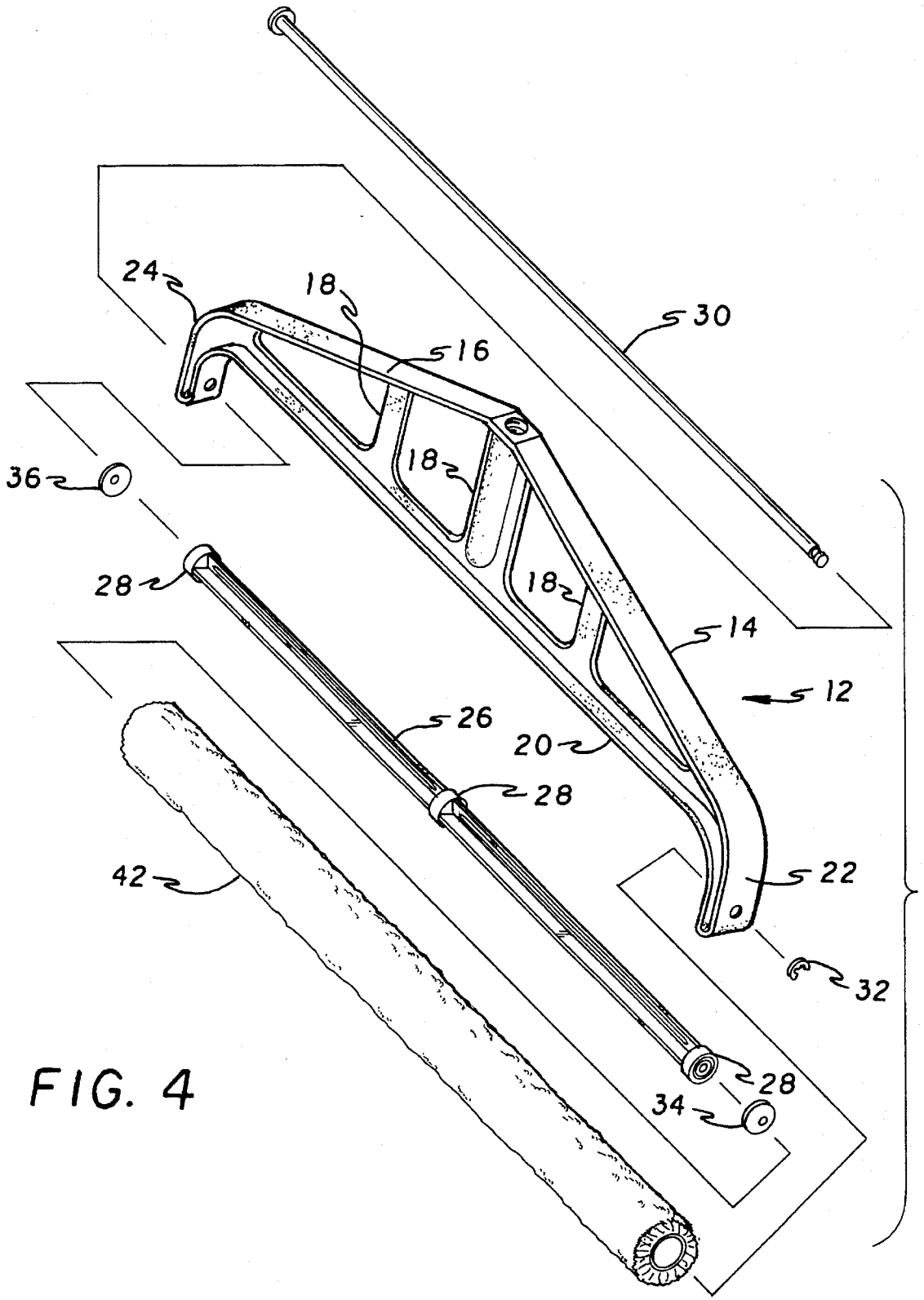
FIG. 4 is an exploded view of the frame, the cylinder assembly, and all components for attachment of the cylinder assembly to the frame.

The cylinder assembly 40, which is best seen in its exploded view in FIG. 4, includes a cylinder 26, around which a nap or cover 42 is placed. The cylinder 26 has integral support means, preferably uniformly-spaced wheels 28. The wheels 28 are spaced along the cylinder 26 at intervals of approximately one foot. These wheels 28 provide the necessary support to the cylinder 26 to prevent bowing, which would result in uneven painting. The cylinder assembly 40 also includes left and right washers 34 and 36 on either end of the cylinder 26. These washers 34 and 36 fit snugly between the arms 22 and 24 of the frame 12 to prevent lateral movement of the cylinder 26. The washers 34 and 36 are concave with respect to either end of the cylinder 26 prevent paint from entering the cylinder 26.

The cylinder assembly 40 is rotatably supported on the arms 22 and 24 of the frame 12 by a rod 30 extending through holes in the arms 22 and 24, the washers 34 and 36, and the cylinder 26. The rod 30 is secured to the frame 12 by a clamp or a metal spring washer 32, preferably a C-clamp.

Figure 2:
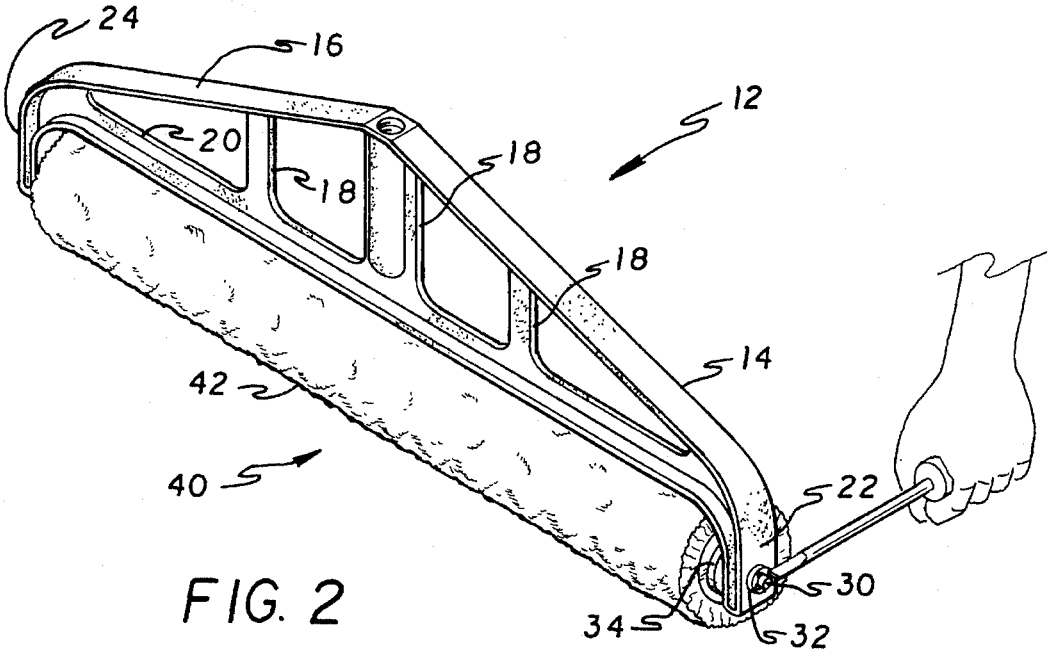
FIG. 2 is a perspective view of the frame and cylinder assembly showing how the rod is detached from the frame.
Figure 3:
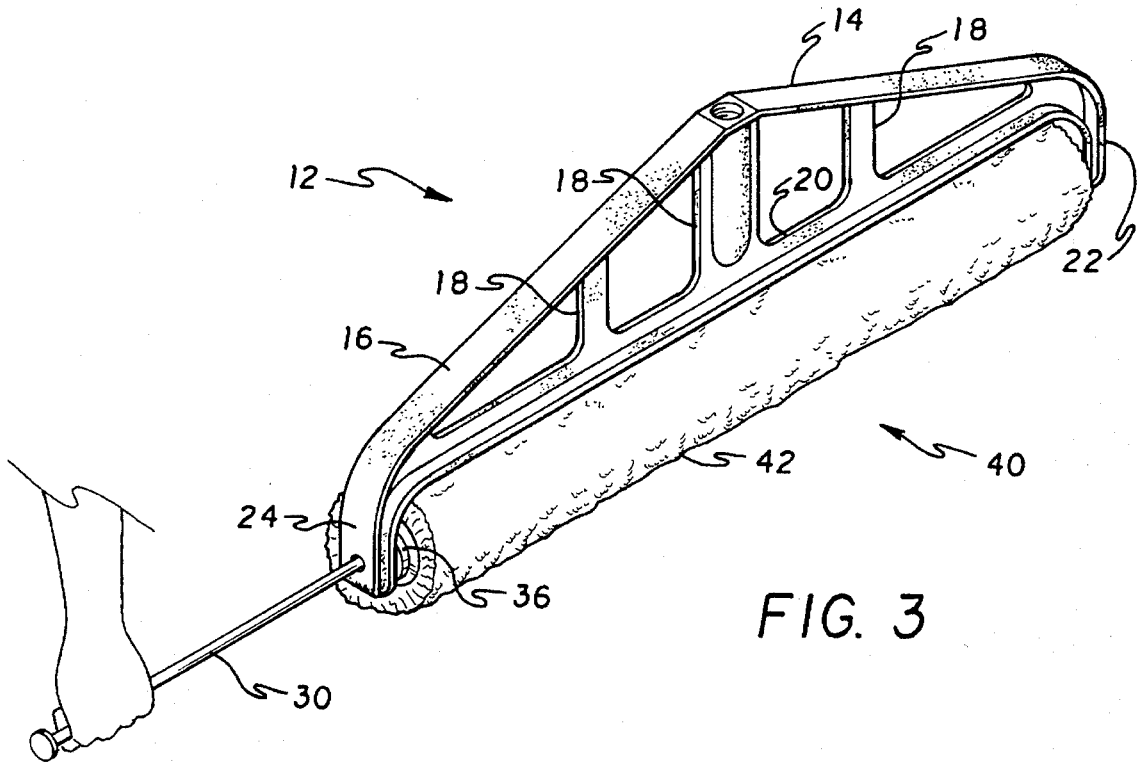
FIG. 3 is a perspective view of the frame and the cylinder assembly showing the rod being removed from the frame and cylinder assembly.

Because the cylinder assembly 40 is supported on both ends, the cylinder assembly 40 must be separated from the frame 12 to remove the cover 42 from the cylinder 26. FIG. 2 shows that the C-clamp 32 is removed from the rod 30 using a screwdriver. FIG. 3 shows that the rod 30 is then pulled out from the cylinder assembly 40 and the frame 12, thus allowing for the easy removal of the cover 42 from the cylinder 26.

It is to be understood that the present invention is not limited to the sole embodiment described above, but encompasses any and all embodiments within the scope of the following claims.

We claim:

1. A paint roller comprising:

a triangular frame having two legs of identical length and a hypotenuse, the area between said hypotenuse and said legs being substantially open, said frame including at least one support member extending from said hypotenuse to said legs, said at least one support member including a central support member having an opening for receiving an extension pole; and a cylinder assembly having first and second sides at opposite ends thereof;

said frame supporting said cylinder assembly on both sides of said cylinder assembly, said hypotenuse of said frame being parallel to said cylinder assembly, and said at least one support member being perpendicular to said cylinder assembly;

said frame including a rod which is removably inserted through said frame and said cylinder assembly for facilitating the removal of said cylinder assembly.

2. The paint roller of claim 1, wherein said central support member bisects the hypotenuse and bisects the angle formed by the intersection of the two legs.

3. The paint roller of claim 1 wherein said at least one support member includes three support members.

4. The paint roller of claim 1, wherein the cylinder assembly includes supports along its length.

5. The paint roller of claim 1 wherein said frame includes an arm extending from each end of said hypotenuse of said frame for supporting said cylinder assembly.

6. The paint roller of claim 1 wherein said frame has a plurality of support elements within said substantially open area.

7. A paint roller comprising:

a triangular frame having two legs of identical length and a hypotenuse, the area between said hypotenuse and said legs being substantially open, said frame including at least one support member including a central support member extending from said hypotenuse to said legs, said central support member having an opening for receiving an extension pole; and a cylinder assembly having first and second sides at opposite ends thereof;

said frame supporting said cylinder assembly on both sides of said cylinder assembly, said hypotenuse of said frame is parallel to said cylinder assembly and said at least one support member being perpendicular to said cylinder assembly;

said frame including means integral therewith for facilitating the removal of said cylinder assembly.

8. The paint roller of claim 7, wherein said means for facilitating the removal of said cylinder assembly includes a rod which is removably inserted through said frame and said cylinder assembly.

9. The paint roller of claim 7, wherein said central support member bisects the hypotenuse and bisects the angle formed by the intersection of the two legs.

10. The paint roller of claim 7, wherein said at least one support member includes three support members.

11. The paint roller of claim 7, wherein the cylinder assembly includes supports along its length.

12. The paint roller of claim 7 wherein said frame includes an arm extending from each end of said hypotenuse of said frame for supporting said cylinder assembly.

13. The paint roller of claim 7 wherein said frame has a plurality of support elements within said substantially open area.

* * * * *